US006237817B1

(12) United States Patent
Son

(10) Patent No.: US 6,237,817 B1
(45) Date of Patent: May 29, 2001

(54) DRINK OR OTHER LIQUID CONTAINER WITH UNFOLDING SPOUT

(76) Inventor: Paul Son, Rue Victor Libert 3, B-6900 Marche-en-Famenne (BE)

( * ) Notice: Subject to any disclaimer, the term of this patent is extended or adjusted under 35 U.S.C. 154(b) by 0 days.

(21) Appl. No.: 09/349,743

(22) Filed: Jul. 8, 1999

(51) Int. Cl.[7] ..... B67D 3/00

(52) U.S. Cl. ..... 222/527; 222/530; 222/533; 222/535; 222/566; 222/572

(58) Field of Search ..... 222/527, 530, 222/533, 535, 538, 566, 572, 574

(56) References Cited

U.S. PATENT DOCUMENTS 1,908,444 * 5/1933 Praechtl ..... 222/528
3,298,577 * 1/1967 Chlystun ..... 222/529
4,216,880 * 8/1980 Drelichowski ..... 222/541.2
4,407,425 * 10/1983 Combs ..... 220/269
5,687,872 * 11/1997 Nmngani ..... 222/710
5,823,404 * 10/1998 Ronchail ..... 222/535

FOREIGN PATENT DOCUMENTS 0 744 355 A1 11/1996 (EP) .

* cited by examiner

*Primary Examiner*—Kevin Shaver
*Assistant Examiner*—David Deal
(74) *Attorney, Agent, or Firm*—Pauley Petersen Kinne & Fejer

(57) ABSTRACT

A drink or other liquid container having a surface with a separable cap. A spout is mounted beneath the separable cap and the spout unfolds outwards when the cap is separated from the container. The unfolding spout is constructed of a flexible tubular piece which folds back on itself, under the cap.

3 Claims, 3 Drawing Sheets

DRINK OR OTHER LIQUID CONTAINER WITH UNFOLDING SPOUT

BACKGROUND OF THE INVENTION

1. Field of the Invention

This invention relates to containers for a beverage or other liquid and in particular to containers such as cans and packing-cases having a closure lid which includes a separable closure strip.

2. Description of Prior Art

To date, in order for a consumer to drink straight out of a can of a pull-ring type, for instance he or she must remove the closure strip from the lid and then push his or her lips against the outer surface of the container. An external surface of the container is usually unsanitary as it is normally contaminated with dirt, germs and pollutions of all kinds while the container is stored and manipulated during the conditioning process, the transporting process and the stocking process of the containers. In the stores, too, the containers are frequently handled by different persons. In the refrigerators of stores, for instance, the containers are handled by many buyers who, among others, wish to appreciate the freshness degree of the containers. Furthermore, containers are often laid down on the floor and are thus within reach of animals or allowed to come into contact with chemical products, refuses, grease, oil and the like. Consequently, the beverage containers currently on the market very often do not remain sanitary for use.

Moreover, it is not uncommon that a consumer drinking straight from a container, in particular a child, cuts his or her lips or tongue. Further, beverage often spills over the top of the container or along the peripheral edge of a container lid.

In order to eliminate the concern about the drinking procedure being unsanitary there is known a closure lid arranged with a spout member which is folded over beneath a separable closure strip and which springs upwardly when the closure strip is separated from the remainder of the lid. However, nothing has been proposed so far to provide the present containers with an unfolding spout without the need to redesign the closure lids for the containers. This invention provides an improvement which solves this problem.

SUMMARY OF THE INVENTION

A container according to this invention includes a base member disposed beneath a closure lid and a spout portion which is folded over beneath a separable closure strip. The spout portion is received within a spout receiving recess formed in the base member and springs upwardly from the folded condition to an extended condition when the closure strip is separated from the remainder of the lid, thereby establishing an open passageway through the spout portion which accommodates the contents of the container and thus permits sanitary and safe drinking through the spout portion.

The base member can be easily manufactured in a standardized manner for insertion into an interior of any container in order to permit sanitary and safe drinking through the spout. The arrangement of the base member permits any usual lid to be used for sealing the containers. Further, the base member according to this invention is compatible with the present dimensions of the containers and can thus be easily placed in the usual automatic distributors and refrigerators.

Other features and advantages of this invention will be apparent from the following description and the accompanying drawings.

DESCRIPTION OF PREFERRED EMBODIMENTS

Figure 1:
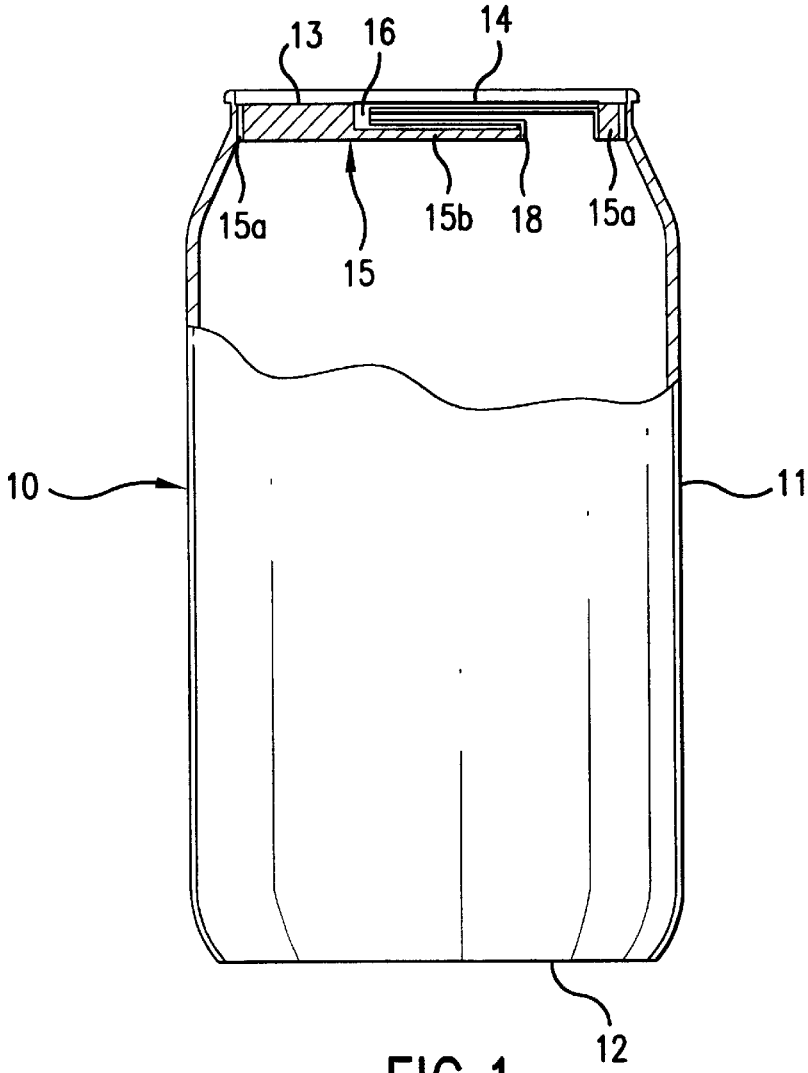
FIG. 1 is a sectional front view of a container according to this invention, with a lid in a closed condition.
Figure 2:
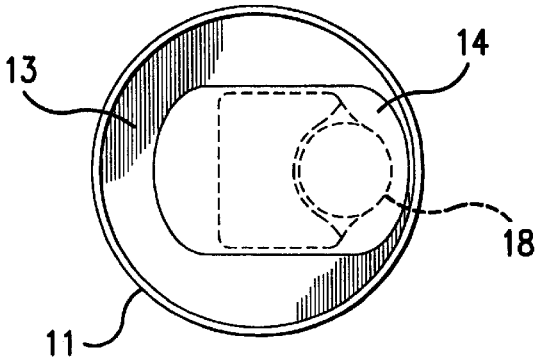
FIG. 2 is a top view of the container of FIG. 1.

Referring to FIGS. 1 and 2, there is illustrated in one preferred embodiment, a can having a body 10 with a lateral wall 11 and a bottom 12, and having a lid 13 including a separable closure strip 14. A pull ring is usually secured to the closure strip 14 to enable a consumer to easily separate the closure strip 14 from the lid 13. The pull ring is not shown in the drawings.

A base member 15 is disposed beneath the lid 13 and is secured at its periphery to the can body 10 such that the base member 15 is located in the mouth of the can and extends in a substantially parallel direction with the closure strip 14. The base member 15 comprises a first base portion 15*a* which is annular in shape and is secured to the lateral wall 11 of the container body 10. To the first base portion 15*a* is secured a second base portion 15*b* which extends substantially parallel to the lid 13. In the second portion 15*b* a spout receiving recess 16 is formed with an opening 17 through the bottom thereof A first end of a tubular spout portion 18, which has an open free end, is secured to a periphery of the opening 17. When the container is in a closed condition as shown in FIG. 1, the tubular spout portion 18 is folded over within the spout receiving recess 16 and is held in its folded condition by the closure strip 14.

The base member assembly, including the first and second base portions 15*a* and 15*b* and the spout portion 18, is inserted in the mouth of the container and secured to the can body 10 after the container is filled and the lid 13 is then sealed to the container using any known process.

Figure 3:
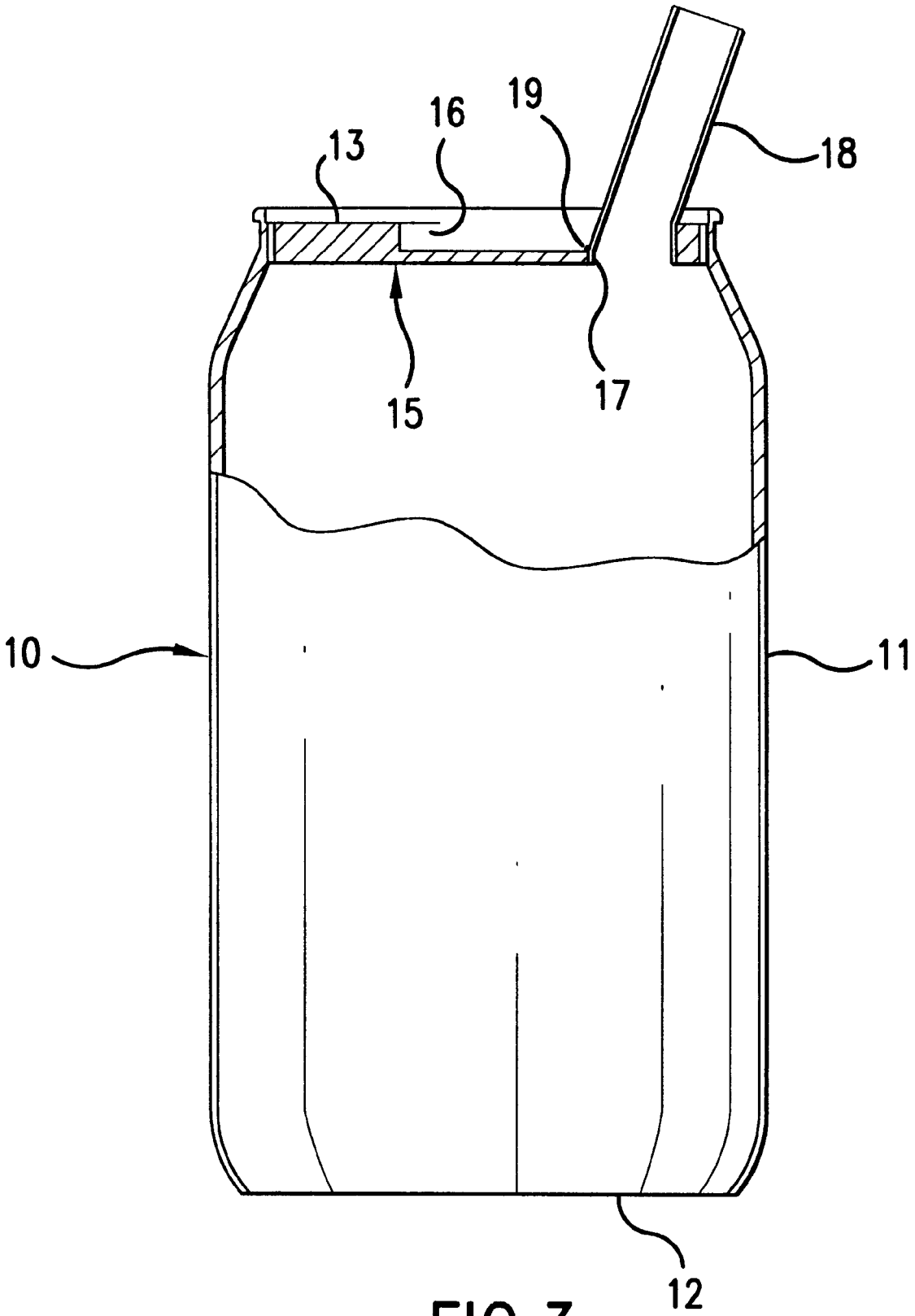
FIG. 3 is a sectional front view of the container of FIG. 1, but with the closure lid in an open condition.
Figure 4:
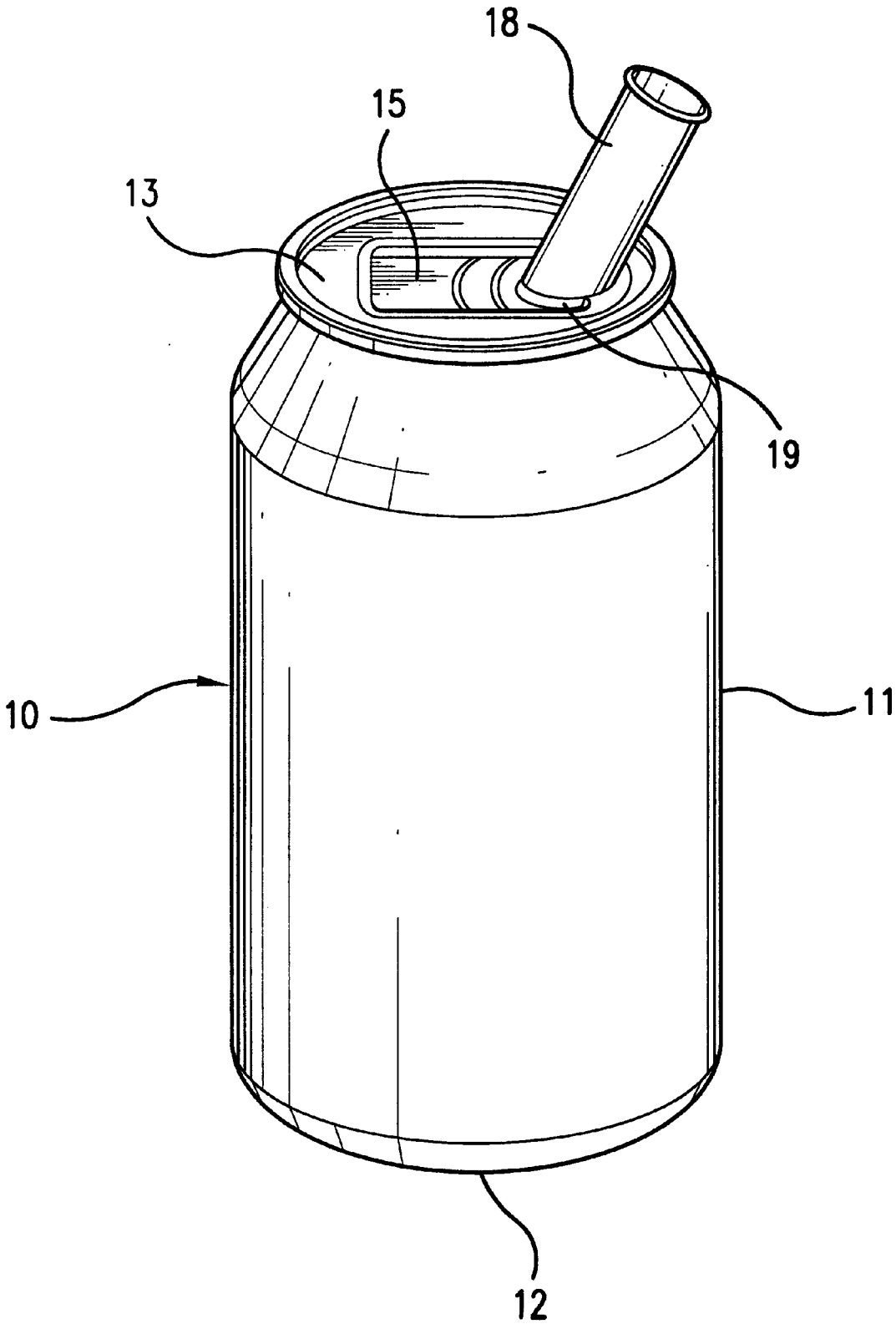
FIG. 4 is a perspective view of the container as shown in FIG. 3.

Upon separating the closure strip 14 from the lid 13 the spout portion 18 can freely spring upwardly from the folded condition to an outward orientation relative to the remainder of the lid 13, as shown in FIGS. 3 and 4. The spout portion 18 in an extended condition establishes an open passageway through which contents of the container can pass and thus permits a consumer to drink the contents of the container by oral contact with only the spout portion 18. Because the spout portion 18 arranged beneath the lid 13 is not exposed to pollution or contamination, the spout portion 18 remains quite sanitary and safe and thus solves the concern of sanitary drinking. Further, because the spout portion 18 in a folded condition is secured from the contents of the container, the spout portion 18 can extend outwardly free from any liquid, whereby the contents of the container is unable to spill over the lid 13. While separating the closure strip 14 from the remainder of the lid 13, the consumer may hold the folded spout portion 18 with a finger until the separable closure strip 14 is completely separated from the remainder of the lid 13. As shown in FIG. 4, a small embossing 19 can be provided at the junction of the tubular spout portion 18 and the base portion 15*b* to improve a tightness of the spout portion 18 in a folded condition.

While preferred embodiments of this invention are illustrated and described in the drawings and the foregoing description, it will be understood that this invention may be applicable to a variety of containers such as cans, packing-cases. "tetrabrik" containers, bottles for various liquids and products (pharmaceutical, chemical, etc.) and many changes and modifications can be made by one skilled in the art without departing from the desired results of this invention.

I claim:

1. A container for a beverage or other liquid, comprising:

a body having a lateral wall and a bottom;

a closure lid having a flat surface and a separable closure strip; and a base member arranged on an interior of said container under said closure lid;

said base member having a first annular portion secured to said lateral wall, a second portion secured to said first annular portion and extending substantially parallel to said closure lid, and a tubular spout portion having a first end and a second free end;

said second portion having a thickness delimited by an external surface and an internal surface and having a spout receiving recess formed therein at said external surface, said spout receiving recess having a bottom with an opening;

said tubular spout portion having said first end secured about a periphery of said opening, with the container in a closed condition said tubular spout portion being folded over beneath said closure strip and received within said spout receiving recess; and with the container in an open condition said tubular spout portion being sprung upwardly from a folded condition to an extended condition when said closure strip is separated from a remainder of the lid and establishing an open passageway within the spout portion through which contents of the container can pass.

2. The container of claim 1, wherein a junction of said tubular spout portion and said second portion of said base member is formed with an embossing along at least a portion of a length of said junction.

3. A base member for inserting beneath a closure lid of a container comprising:

a body having a lateral wall, a closure lid having a separable closure strip, said base member comprising a first annular portion secured to the lateral wall, a second portion secured to said first annular portion and having a thickness delimited by an external surface and an internal surface, said second portion having a spout receiving recess formed at said external surface with an opening through a bottom of said recess, and a tubular spout portion having a first end secured about a periphery of said opening and a second free end, said tubular spout portion arranged to be folded over within said spout receiving recess and to be unfolded from a folded condition to an extended condition to establish an open passageway extending through said spout portion.

* * * * *

UNITED STATES PATENT AND TRADEMARK OFFICE

CERTIFICATE OF CORRECTION

PATENT NO. : 6,237,817 B1
DATED : May 29, 2001
INVENTOR(S) : Paul Son

It is certified that error appears in the above-identified patent and that said Letters Patent is hereby corrected as shown below:

Title page,
Item [30], Foreign Application Priority Data, insert the following:

-- [30] Foreign Application Priority Data Jan. 8, 1997 [BG]
Belgium……..09700014 --

Signed and Sealed this

Seventh Day of September, 2004

JON W. DUDAS
*Director of the United States Patent and Trademark Office*